US005815952A

United States Patent [19]

Bobrowicz

[11] Patent Number: 5,815,952

[45] **Date of Patent: *Oct. 6, 1998**

[54] SHOE FOR THE PRACTICE OF A GLIDING SPORT

[75] Inventor: Eric Bobrowicz, Hautes Alpes, France

[73] Assignee: Skis Rossignol S.A., France

[ * ] Notice: This patent issued on a continued prosecution application filed under 37 CFR 1.53(d), and is subject to the twenty year patent term provisions of 35 U.S.C. 154(a)(2).

[21] Appl. No.: 641,874

[22] Filed: May 2, 1996

[30] Foreign Application Priority Data

May 5, 1995 [FR] France ..... 95 05615

[51] Int. Cl.[6] ..... A43B 5/04

[52] U.S. Cl. ..... 36/117.3; 36/117.1

[58] Field of Search ..... 36/89, 115, 117.3, 36/117.4, 55, 117.2

[56] References Cited

U.S. PATENT DOCUMENTS

| | | | |
|---|---|---|---|
| 4,959,912 | 10/1990 | Kaufman et al. | 36/117.4 |
| 5,068,984 | 12/1991 | Kaufman et al. | 36/117.4 |
| 5,090,138 | 2/1992 | Borden | 36/89 X |
| 5,291,621 | 3/1994 | Caberlotto et la. | 36/89 X |
| 5,474,322 | 12/1995 | Perkins et al. | 36/117.3 X |
| 5,499,461 | 3/1996 | Danezin et al. | 36/118.2 X |
| 5,520,406 | 5/1996 | Anderson et al. | 280/624 |
| 5,588,228 | 12/1996 | Foscaro et al. | 36/89 X |
| 5,606,808 | 3/1997 | Gilliard et al. | 36/89 |
| 5,636,455 | 6/1997 | Meiselman | 36/115 |
| 5,704,139 | 1/1998 | Okajima | 36/117.3 X |

FOREIGN PATENT DOCUMENTS

| | | | |
|---|---|---|---|
| 370957 | 3/1983 | Austria . | |
| 556799 | 8/1993 | European Pat. Off. | 36/118.1 |
| 0646334 | 4/1995 | European Pat. Off. . | |
| 2385346 | 10/1978 | France . | |
| 1302832 | 6/1975 | Germany . | |
| 3622746 | 1/1988 | Germany . | |
| WO94/26365 | 11/1994 | WIPO | 36/117.3 |

*Primary Examiner*—B. Dayoan

[57] ABSTRACT

A shoe (1) for the practice of a gliding sport using at least one board, having a capacity for forward flexing and having arrangements intended to interact with a binding, of the type including a flexible boot (2) and a removable flexible inner shoe (4) placed inside the flexible boot (2); a shell (3) placed inside the flexible boot (2), between the boot (2) and the inner shoe (4), and having at least one sole (12) intended to accommodate the sole of the user's foot, and a spoiler (13) intended to fit around the rear of the user's lower leg, up to the height of the bottom of the calf. The sole/spoiler assembly (12, 13) has capacities for inclination of the spoiler (13) toward the front of the sole (12) and a rigidity capable of limiting the rearward inclination of the spoiler (13). The arrangements (34) intended to interact with the binding are fixed on the sole (12) of the shell through the flexible boot (2).

20 Claims, 13 Drawing Sheets

SHOE FOR THE PRACTICE OF A GLIDING SPORT

TECHNICAL FIELD

The invention relates to the field of gliding ports, in particular those involving gliding on water and on snow. It more precisely relates to a shoe intended for the practice of snowboarding or on-piste skiing.

The invention will be described in more detail below in the context of its application to snowboarding, even though it can be adapted directly for the practice of alpine skiing.

PRIOR ART

As is known, there are several techniques for the practice of snowboarding. Mention may, in particular, be made of a first form termed "alpine gliding" which is practiced on traditional downhill ski pistes, on prepared snow. A second form termed "freestyle" is also known, which takes place on particular runs forming semicylindrical valleys, generally artificially hollowed, and commonly referred to by the expression "halfpipe". Finally, it is also known that snowboarding is practiced on powdery snow slopes.

It is quite clear that each of these modes of use requires a number of properties in the articulation between the user's leg and the board, in particular as regards forward flexing and rearward support.

Chronologically, four different types of shoe have been proposed, to be combined with corresponding bindings which are also different.

Firstly, the earliest shoes used for the practice of snowboarding are derived from the boots used for alpine skiing, that is to say having a rigid shell allowing limited forward inclination of the leg. These shoes are fitted to bindings having two elements, namely a fixed stirrup piece into which the heel of the shoe is inserted, and an articulated front stop in the form of a stirrup, capable of engaging the front portion of the toe of the shoe. Quite clearly, this type of shoe proves to be too rigid, in particular in disciplines requiring large angulations of the tibia relative to the foot, such as the technique practiced in halfpipes. This type of shoe also proves to be poorly suited for walking.

Subsequently, the use of flexible shoes was proposed, these most generally having the form of a boot which is advantageously practical for walking. Unfortunately, the existence of this flexibility made it necessary to develop the bindings in order to allow them to cater for rearward support. A number of bindings were thus developed having a platform on which the shoe is fixed by several straps and which has a rigid rear plate fixed substantially perpendicularly to the board and rises toward the calf. Unfortunately, although satisfactory, this type of binding constitutes a molded part which is particularly complex to produce, bulky and difficult to transport. It furthermore does not permit automatic fitting and removal of the shoe. Thus, at the bottom of each run, the snowboarder must undo the straps in order to release himself, and when he reaches the ski lift he must refix the straps and adjust their tightening, which proves to be tedious and tiresome.

A third type of binding is further known, combining a block which is fixed on the board and which interacts with complementary arrangements, advantageously retractable, which are securely fastened to the shoe. This type of shoe is relatively rigid, and is either similar to a traditional ski boot or has a sole made of hard material and a rigid back upper for allowing rearward support. It is thus seen that the use of this advantageous type of binding requires the use of a rigid shoe which therefore has drawbacks for walking and does not make it possible to obtain optimum performance during the practice of snowboarding.

Finally, a snowboarding shoe of the boot type, inside which a shell interposed between the outer upper and the inner shoe is inserted, is known, in particular from document EP-A-0,646,334. This shell comprises a sole intended to accommodate the sole of the user's foot and a back spoiler intended to fit around the rear of the bottom of the user's leg up to the height of the bottom of the calf. This spoiler is articulated to the upright rear part of the sole so as to permit transverse inclination of this spoiler. Unfortunately, this solution is not fully satisfactory insofar as the intermediate shell is simply placed inside the upper and is not at all rigidly joined to the board. The forces are therefore transferred from the binding through the fastening straps of the boot and the flexible sole. It is easy to see that the flexibility of these various elements lessens the degree of feel and does not permit optimum performance. In addition, by virtue of the freedom of movement of this shell inside the boot, when the rear support is engaged, the front of the foot rises and becomes compressed under the straps forming the binding. As a result, this is awkward and uncomfortable.

The invention overcomes these drawbacks.

BRIEF DESCRIPTION OF THE INVENTION

The problem which the invention proposes to solve is the use of a shoe which can be coupled to a simple binding, of the type operating by clip fastening, this shoe being flexible forward while having a rearward rigidity for permitting support.

Another problem which the invention proposes to solve is that of efficient transfer of forces from the board to the user's foot, in order to permit accurate feeling of the sensations resulting from snowboarding.

The invention thus relates to a shoe for the practice of a gliding sport using at least one board, having a capacity for forward flexing and having arrangements intended to interact with a binding, of the type comprising:

- a flexible boot and a removable flexible inner shoe placed inside the flexible boot;
- a shell placed inside the flexible boot, between this boot and the inner shoe, and having at least one sole intended to accommodate the sole of the user's foot, and a spoiler intended to fit around the rear of the user's lower leg, up to the height of the bottom of the calf.

This shoe is one wherein the sole/spoiler assembly has capacities for inclination of the spoiler toward the front of the sole and a rigidity capable of limiting the rearward inclination of the spoiler, and wherein the arrangements intended to interact with the binding are fixed on the sole of the shell through the flexible boot.

Put another way, in order to combine forward flexibility and rearward rigidity, the shoe according to the invention has a shell serving as a frame and having a capacity for articulation in the longitudinal direction which is oriented forward only. This frame is firmly and rigidly combined with the members for fastening to the binding through the sole of the flexible boot which serves as an outer covering, preferably at the arch of the foot or else in the heel or toe zone.

In other words, in contrast to all the existing shoe types, the invention provides a flexible shoe which is therefore practical for walking, can be coupled to a simple binding and combines forward flexibility with rearward rigidity and optimum transfer of forces.

To solve the problem of the interaction of the shoe with the binding, the arrangements intended to interact with the binding are fixed on the shell of the shoe through the boot, either at the arch of the foot or at the heel, or else jointly at the front end and at the heel. In other words, the piece for connecting to the binding is securely fastened, by screwing or any other means, directly to the rigid shell and not to the boot, which makes it possible to use a more flexible material for the latter. This arrangement allows direct transfer of forces between the foot and the binding, in spite of the flexibility of the boot, which gives the user better feel.

In a first embodiment, the lower edge of the spoiler is securely fastened to and matches the contour of at least the posterior part of the sole, while the upper edge of the spoiler is free, so that the top part of the spoiler has a radius of curvature slightly greater than that of the bottom part.

In this way, the spoiler has an overall curvature turned toward the front of the sole, which prevents rearward-oriented deformations thereof. The difference in curvature between the top and the bottom of the spoiler promotes the forward flexibility of the latter. The shape of the spoiler thus combines the two functions of flexibility and rigidity.

In another form of the invention, the shoe is equipped with articulation means capable of permitting the inclination of the spoiler toward the front of the sole and with means capable of limiting the rearward inclination of the spoiler. In this way, the two functions of flexibility and rigidity are fulfilled by separate zones of each part of the shell.

In a first embodiment, the shell is monobloc and:

the articulation means consist of a flexible connecting portion joining the sole and the spoiler;

and the inclination limiter means consist of at least one cable joining one side of the sole to the front of one side of the spoiler.

In a variant, the inclination limiter means consist of two inextensible lateral webs joining one side of the connecting portion, the posterior part of the sole and the front of one side of the spoiler.

In a second embodiment, in which the shell is formed by two separate pieces, respectively the sole and the spoiler:

the articulation means consist of two pivot/hole assemblies located respectively at the rear lateral part of the sole and at the bottom lateral part of the spoiler, at the malleoli, and capable of allowing inclination and articulation of the spoiler relative to the sole;

and the limiter means consist of a protruding portion located on the sole, intended to interact with a complementary portion of the spoiler in order to serve as a stop so as to prevent rearward inclination of the spoiler.

In order to improve the comfort of the user during walking, the complementary portion of the spoiler is articulated to said spoiler about a transverse pin so as to tilt between two positions which permit or prevent abutment with the protrusion, and this complementary portion has return means returning it into the position forming a stop, so that the inclination limiter means can be disengaged on action by the user. Thus, during the walking phases, the part of the complementary portion facing the protuberance is retracted simply by pressing and the spoiler again becomes free to rotate rearward relative to the sole.

In an advantageous alternative embodiment, permitting articulation not only in the longitudinal direction but also in the transverse direction, the means for articulation of the spoiler relative to the sole of the shell consist of:

a stirrup piece joining the malleoli, passing behind the Achilles tendon, and articulated relative to the sole of the shell about a transverse pin arranged substantially at the malleoli;

a longitudinal pivot located at the rear of the stirrup piece and accommodating the bottom part of the spoiler in order to permit it a transverse inclination.

In an equivalent alternative embodiment, in which the aforementioned articulation pins are interchanged, the articulation means consist of:

a stirrup piece joining the malleoli, passing behind the Achilles tendon, and articulated relative to the sole of the shell about a longitudinal pin arranged on the rear part of the sole of the shell, at the Achilles tendon;

two pivot/hole assemblies located respectively on the ends of the stirrup piece, at the malleoli and on the bottom lateral parts of the spoiler, also at the malleoli.

In one embodiment, in order to facilitate fitting of the spoiler and its manufacture, the shell can be removed and extracted from the boot. In a contrasting embodiment, the bottom part of the boot is molded over the shell. Thus, in some cases, the frame can be withdrawn from the boot in order to use the latter for other activities.

Still with the aim of facilitating walking, while permitting rearward support engagement, in one variant the sole extends forward to and slightly set back from the metatarsophalangeal articulation.

In another variant, the sole has, at and slightly set back from the metatarsophalangeal articulation, a less thick zone intended to facilitate articulation of the front of the sole.

In order to improve the firmness of the top part of the shoe, the spoiler has means for tightening around the bottom of the calf. Similarly, and with the same purpose, the sole has means for holding the foot at the instep.

In order to facilitate secure fastening and to improve sealing, the sole of the boot has a zone of reduced thickness at the location where the arrangements intended to interact with the binding are fastened.

To this end, the sole may also include male or female metal or composite inserts intended to serve as engagement points for the arrangements.

Advantageously, polyurethane or polyethylene or any other similar plastic or even composite is used as the material for producing the shell. Of course, to obtain optimum performance, different materials may be chosen for the various parts of the shell, namely the sole and the spoiler.

BRIEF DESCRIPTION OF THE FIGURES

The advantages and the ways of implementing the invention will emerge clearly from the description of the embodiments which follow, supported by the appended figures.

EMBODIMENTS OF THE INVENTION

As already stated, the object of the invention is to provide a snowboarding shoe having a capacity for forward flexing as well as a high degree of rearward rigidity in order to permit support.

Figure 1:
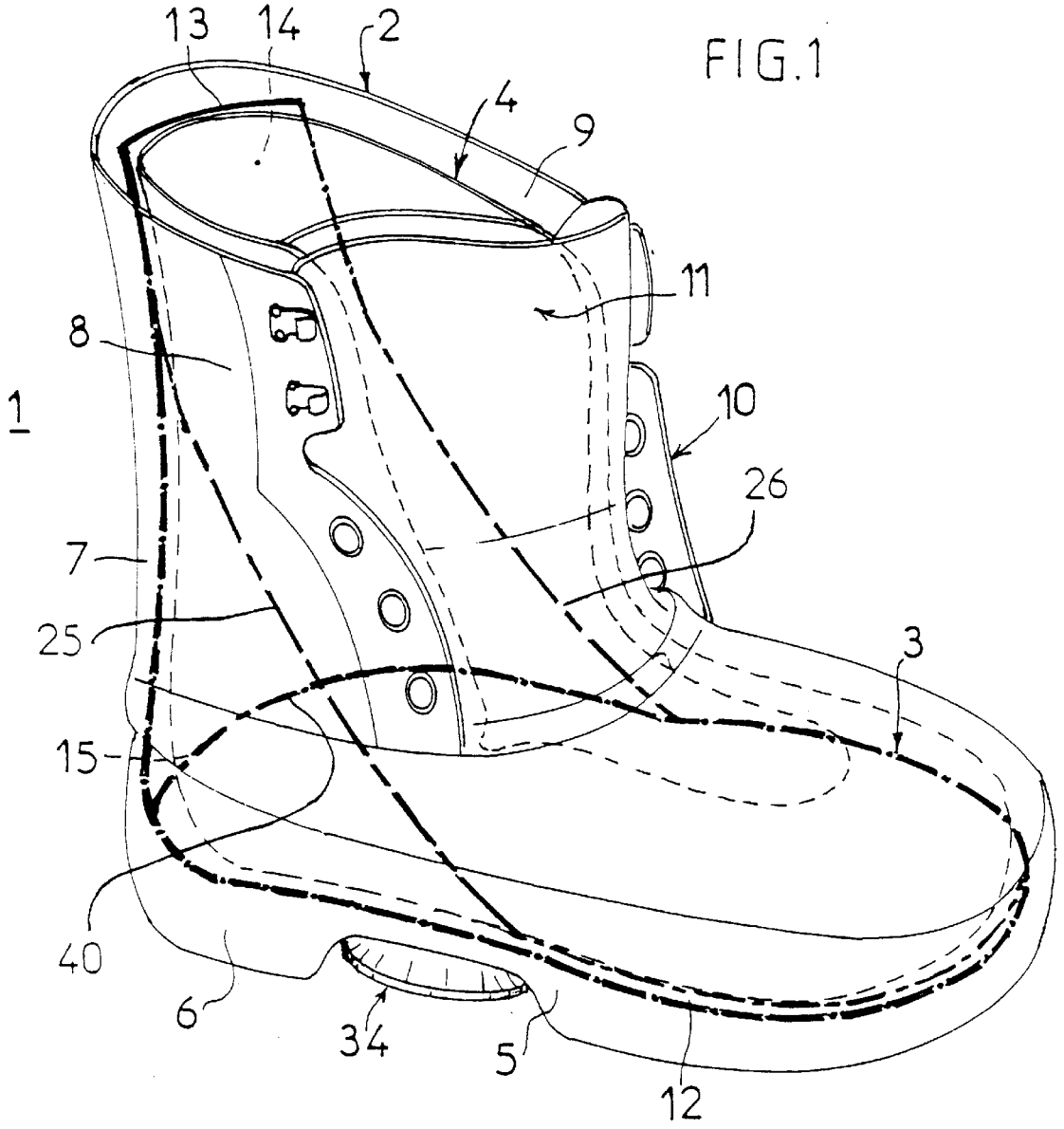
FIG. 1 is a schematic perspective view showing the various subassemblies of the invention.

As shown in FIG. 1, the shoe (1) is composed of three essential subassemblies, namely a flexible boot (2), a removable inner shell (3) and an inner shoe (4).

The flexible boot (2) has a conventional outer shape which is known in the field of snowboarding. Thus, this boot includes, in its lower part, a sole (5) having a heel (6) and, in its upper part, an upper (7) having two lateral flanks (8, 9) each of these flanks having, in its front part, a lacing zone (10) making it possible to cover an inner tongue (11). The upper (7) is oriented slightly forward.

Inside this boot (2) is found the inner shell (3) (in bold dot and dashed lines in FIG. 1) which is composed of two main parts, namely a sole (12) and a spoiler (13). The sole (12) has an anatomical general shape. It has sides which match the contours of the foot and rise slightly in order to ensure good support.

Figure 3:
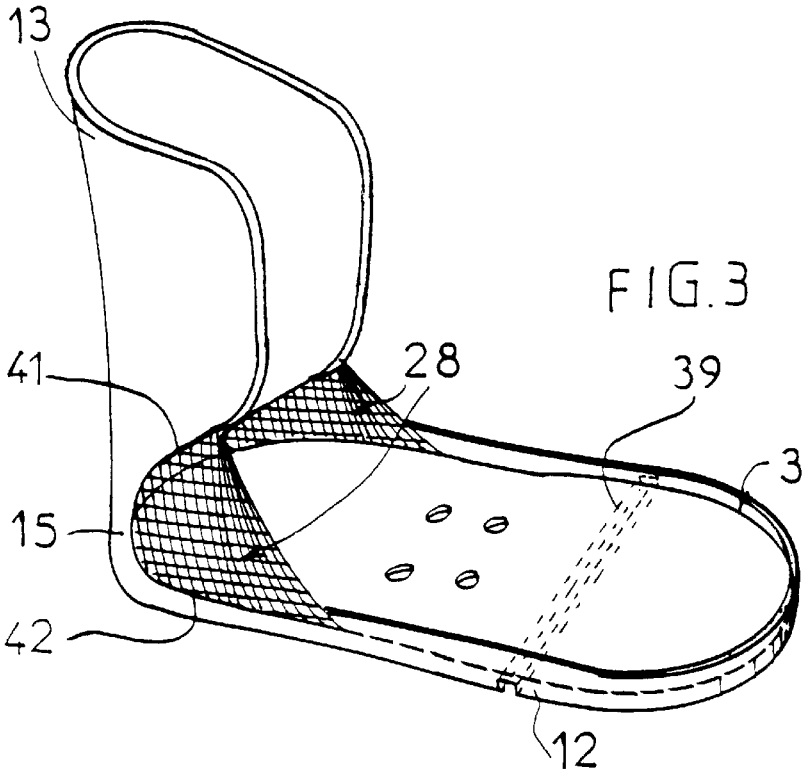

In general, the sole (12) should simultaneously permit rearward supporting during the practice of snowboarding and articulation of the front of the foot during walking phases. Thus, in a first embodiment (cf. FIG. 4), the front end of the sole (12) is slightly set back from the metatarsophalangeal articulation. In another embodiment, the sole (12) extends under all of the bottom of the foot but has, at the metatarsapholangeal articulation, a less thick zone (39) which facilitates articulation of the front of the foot (cf. FIG. 3).

In the embodiment illustrated in FIG. 1, the spoiler (13) is a curved plate whose lower edge (40) is joined to the rear of the sole while surrounding the heel up to the height of the middle of the arch of the foot. The radius of curvature of this portion is less than 5 centimeters. The top part (14) is of smaller width. It constitutes a free end whose radius of curvature is much greater. The configuration of this spoiler therefore permits it to flex forward easily while rearward inclination is impossible.

Figure 2:
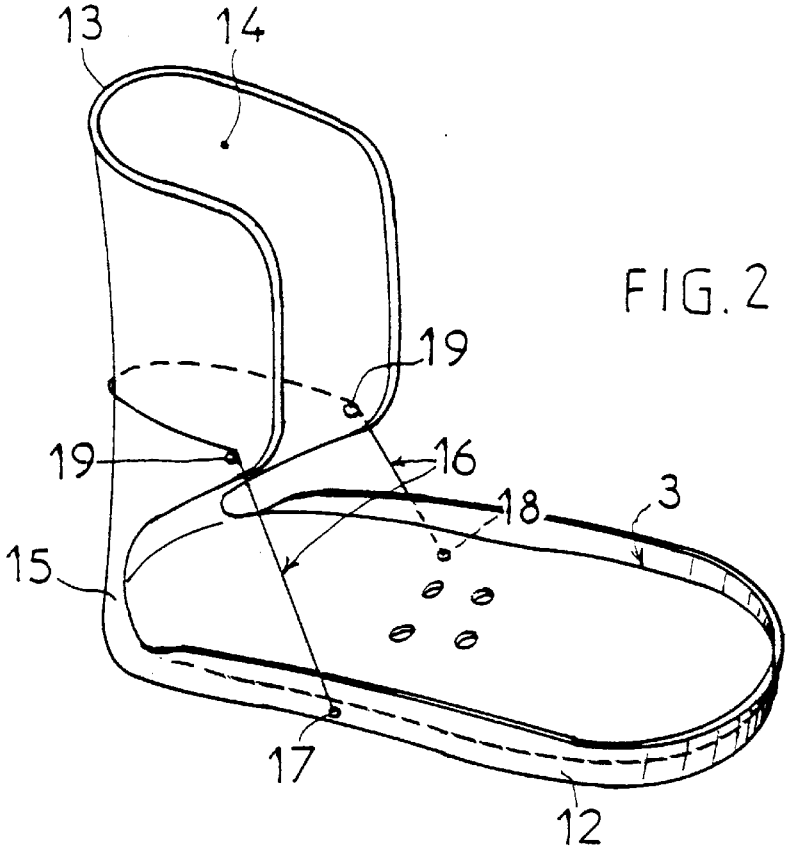
FIG. 2 is a schematic perspective view of a monobloc shell having a particular articulation form, a variant of which is illustrated in schematic perspective in FIG. 3.

In a first variant illustrated in FIG. 2, the spoiler has a general shape circumscribed by a vertical cylinder, with a part (14) that is open toward the front. The width of this opening is designed in order to facilitate placement of the shoe (4) as well as with a view to comfort. The shell (2) consists of a single piece, the spoiler (13) and the sole (12) being joined by a small flexible portion (15) located at the Achilles tendon. This flexible portion (15) permits forward inclination of the spoiler (13).

Since one of the objects of the invention is to completely prevent rearward inclination of the spoiler, the shell also has a cable (16) which joins the sole (12) to the spoiler (13). This object can also be achieved by joining the facing edges (41, 42) of the spoiler and of the sole by a textile web (28) or a sheet of inextensible and flexible material.

Of course, replacing the aforementioned cable with a band molded with the shell, and therefore consisting of the same material, which joins the sole to the spoiler would not depart from the scope of the invention.

In one embodiment, the two ends (17, 18) of the cable (16) are joined to the median part of the sole, in the lateral regions, while the cable (16) passes around the rear of the spoiler (13), bearing on anchoring studs (19). The length of the cable is designed so that it is under tension when the spoiler (13) is in the extreme rearward position.

Of course, the invention encompasses all alternative ways of routing the cable (16) making it possible to limit this rearward inclination.

Figure 4:
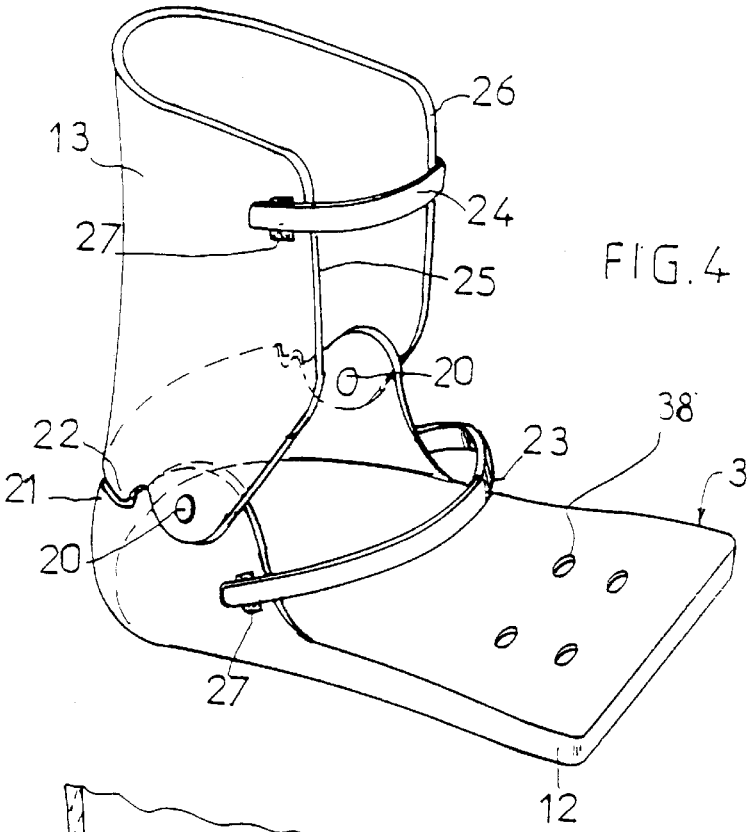
FIG. 4 is a schematic perspective view of a shell in two articulated parts.

In the alternative embodiment illustrated in FIG. 4, the sole (12) and the spoiler (13) form two separate elements joined by a conventional articulation. This may, for example, involve a combination (20) of pivots and holes placed advantageously at the malleoli. This articulation (20) thus permits relative orientation of the spoiler (13) relative to the sole (12). As in the case of the previous variant, rear support is obtained by the presence of a protruding portion (21) at the rear of the sole (12), on which portion the rear end (22) of the spoiler bears. Of course, giving these various ends any shapes capable of creating this stop effect would not depart from the scope of the invention.

Figure 5:
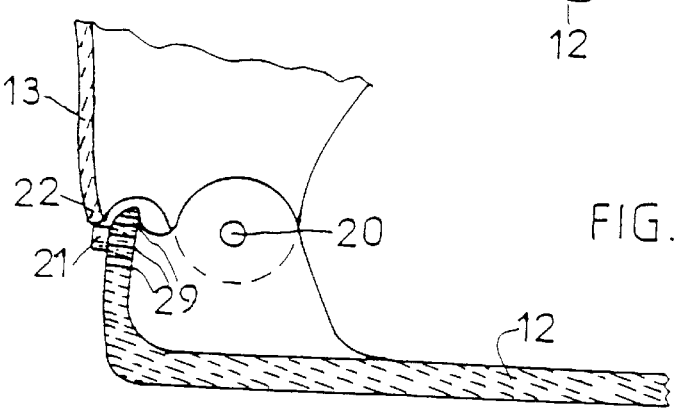
FIG. 5 is a sectional view of a detail of an adjustment of the articulation of a shell of the type in FIG. 4.

As shown in FIG. 5, the shell may be given the capacity for positionally adjusting the rear stop **(21*a*) at a variable height. To this end, the rear part of the sole has holes (29) into which the stop (21)** equipped with an engagement finger is inserted. Of course, this adjustment may be carried out using any other known means such as screwed studs or a crenelated surface.

Figure 6:
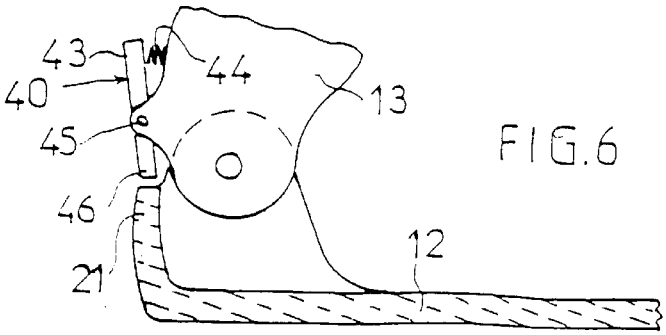
FIG. 6 is a sectional view of a detail of the articulation of a shell of the type in FIG. 4, illustrating the disengagement of the inclination limiter means.

A variant of the invention illustrated in FIG. 6, provides for the possibility of disengaging the inclination limiter means. To this end, the spoiler has a portion (40) which is articulated by means of a fork joint (45). A spring (44) is placed between the spoiler and the top end of the articulated portion, so that the bottom end (46) of this articulated portion (40) faces the protruding position (21) of the sole (12). Simply by pressing on the top end (43), the bottom end (46) retracts and clears the protruding position (21), which disengages the stop mechanism. This makes it possible to improve the comfort of the user when fitting and removing the shoe and during walking.

As shown by FIG. 4, another characteristic of the invention is that it permits proper support of the foot, whether on the sole, by a strap (23) located at the instep, or else at the bottom of the leg by virtue of a strap (24) joining the two inclined faces (25, 26) of the spoiler (13). Of course, these straps may be made of an elastic material, or of a rigid band, or else, as illustrated, with an adjustment system (27) making it possible to adjust the shoe to the user's foot. It is further possible to provide a hole in the flanks (8, 9) of the boot (2) in order to allow a strap (24) to be passed through, so as to arrange the adjustment element outside the shoe, and thus to facilitate its actuation.

In addition, since this shell (3) is in place inside the boot (2), it is intended to accommodate the inner shoe (4).

Figure 7:
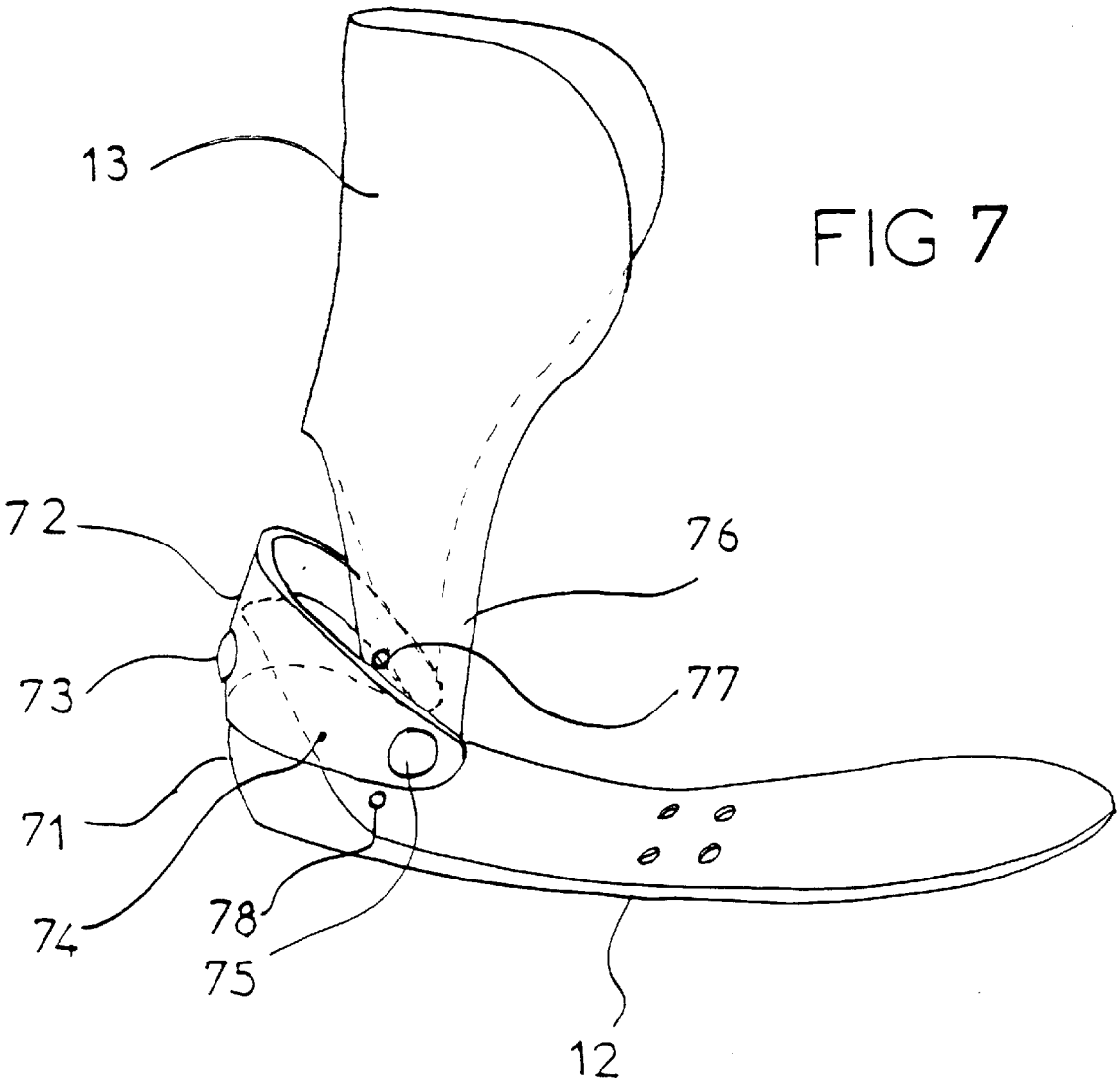
FIGS. 7 and 8 are schematic perspective views of alternative embodiments of shells having capacities for forward longitudinal as well as transverse articulation.

In the improved variant illustrated in FIG. 7, the sole (12) of the shell includes a part (71) which rises toward the rear and surrounds the heel. This upright part (71) has at the top a rivet (73) which articulates a stirrup piece (72). This rivet (73) is arranged longitudinally so as to permit transverse pivoting of the stirrup piece (72).

Starting from the Achilles tendon zone, this stirrup piece (72) has two branches (74) extending as far as the malleoli. Thus, as illustrated in FIG. 7, this stirrup piece (72) and, more precisely, the branches (74) have at their ends rivets

(75) which engage and articulate the spoiler (13) at its lateral extensions (76). The two rivets (75) therefore constitute a virtual articulation axis oriented transversely relative to the shoe. They therefore permit inclination of the spoiler (13) in the longitudinal direction. For its part, by virtue of its articulation to the sole (12), the use of the stirrup piece (72) ensures the possibility of transverse inclination of the spoiler (13).

The rearward inclination of the spoiler (13) is limited by virtue of the presence of lugs (77) which are arranged projecting from the outer face of the lateral extensions (76) of the spoiler and which come into contact with the upper edge of the stirrup piece (72) in the extreme rearward inclination position. In the same logic, the lugs (78) are arranged laterally on the upright part (71) of the sole (12) in order to limit the transverse inclination of the stirrup piece (72).

Figure 8:
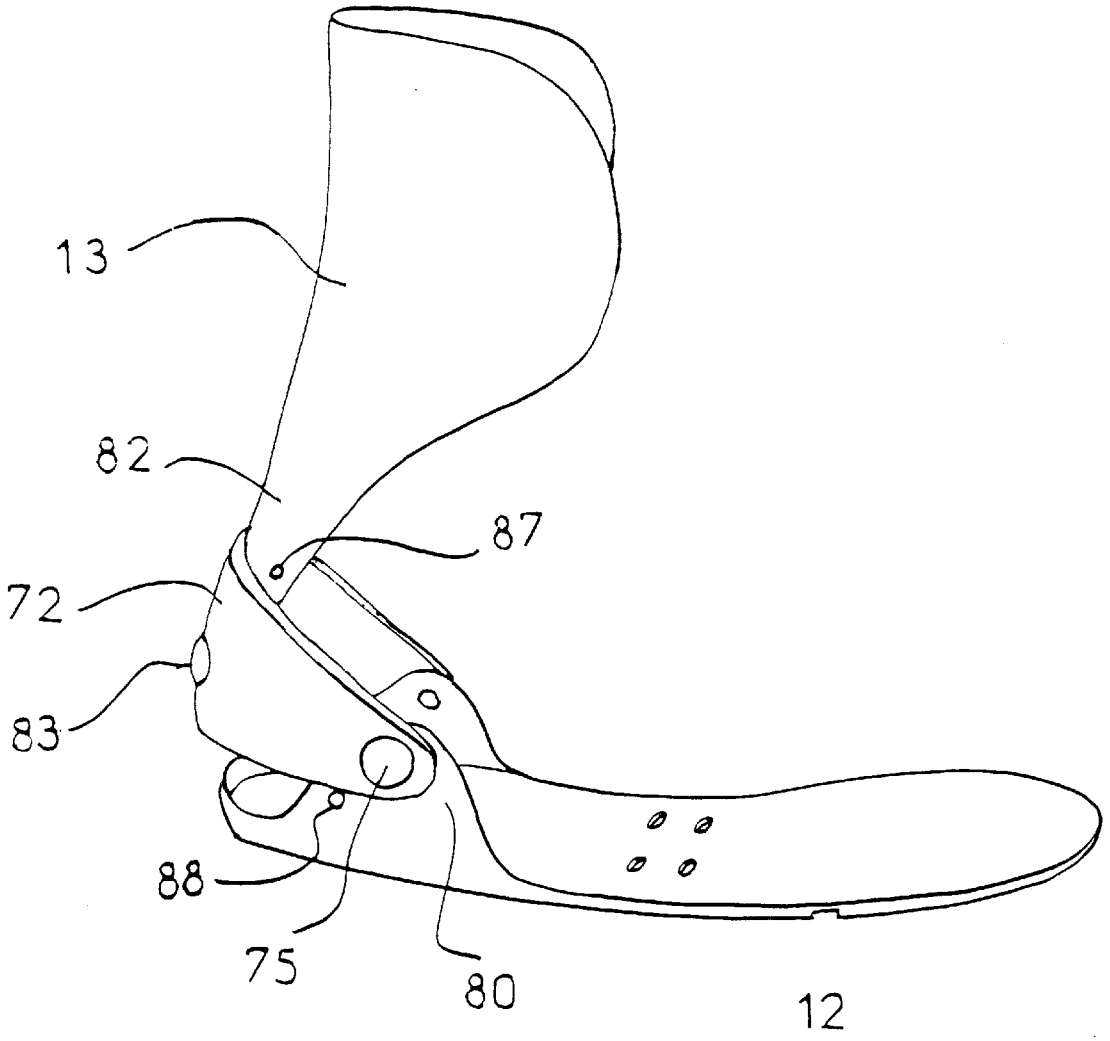

In a derived variant illustrated in FIG. 8, the stirrup piece (72) is articulated by its rivets (75) to two vertical extensions (80, 81) of the sole (12) which are located substantially at the malleoli. At the same time, the spoiler (13) has an extension (82) covering the Achilles tendon. This extension (82) is articulated to the stirrup piece (72) by the rivet (83). This similar architecture thus makes it possible to obtain the same capacities for transverse and lateral inclination as those illustrated in FIG. 7. In this figurative case, the lugs (87, 88) replace the lugs (77, 78) of the frame illustrated in FIG. 7.

Of course, the articulation of the stirrup piece (72) to the spoiler (13) and to the sole (12) is not limited to a rivet embodiment but may also be ensured by any equivalent means such as a hole and pivot set or the like.

Another essential object of the invention is to permit the use of this shoe on particularly simple bindings (30) and to ensure optimum transfer of forces from the board to the foot.

Figure 9:
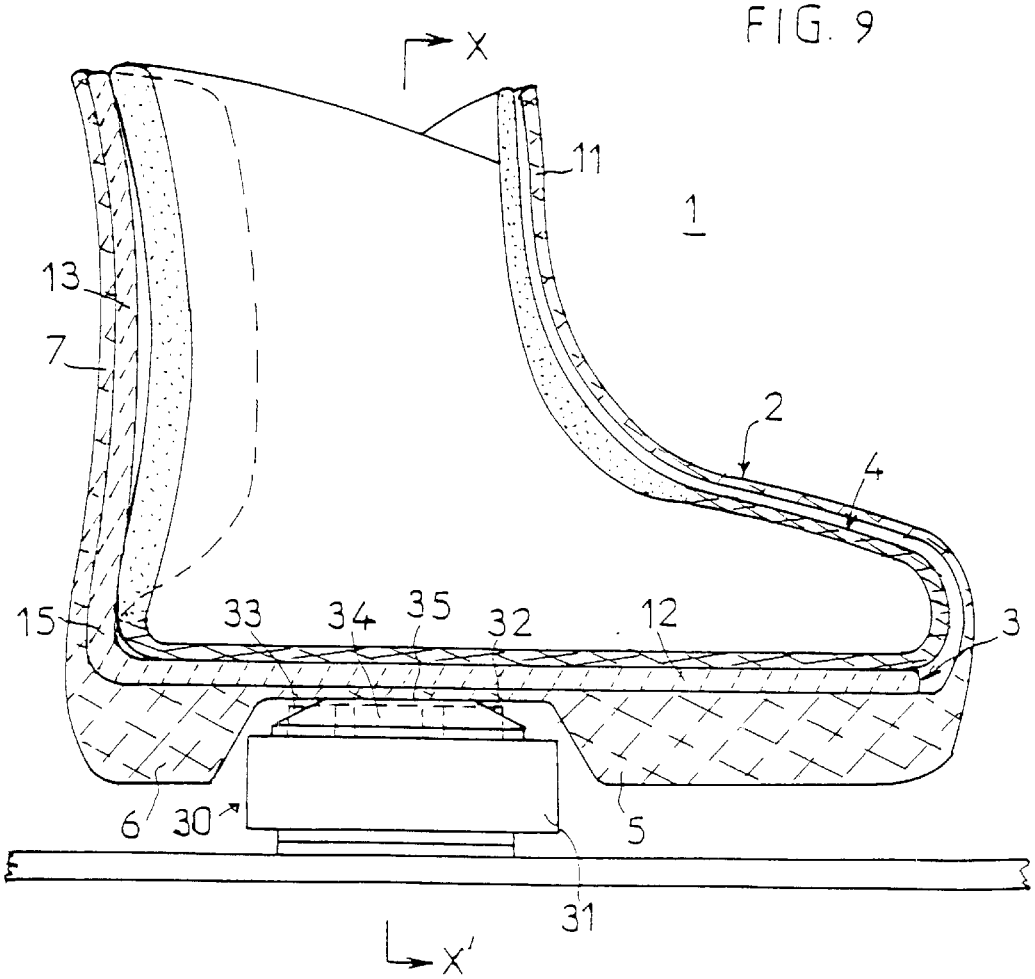
FIG. 9 is a sectional view of the shoe and the binding, showing the interaction between these two elements.
Figure 10:
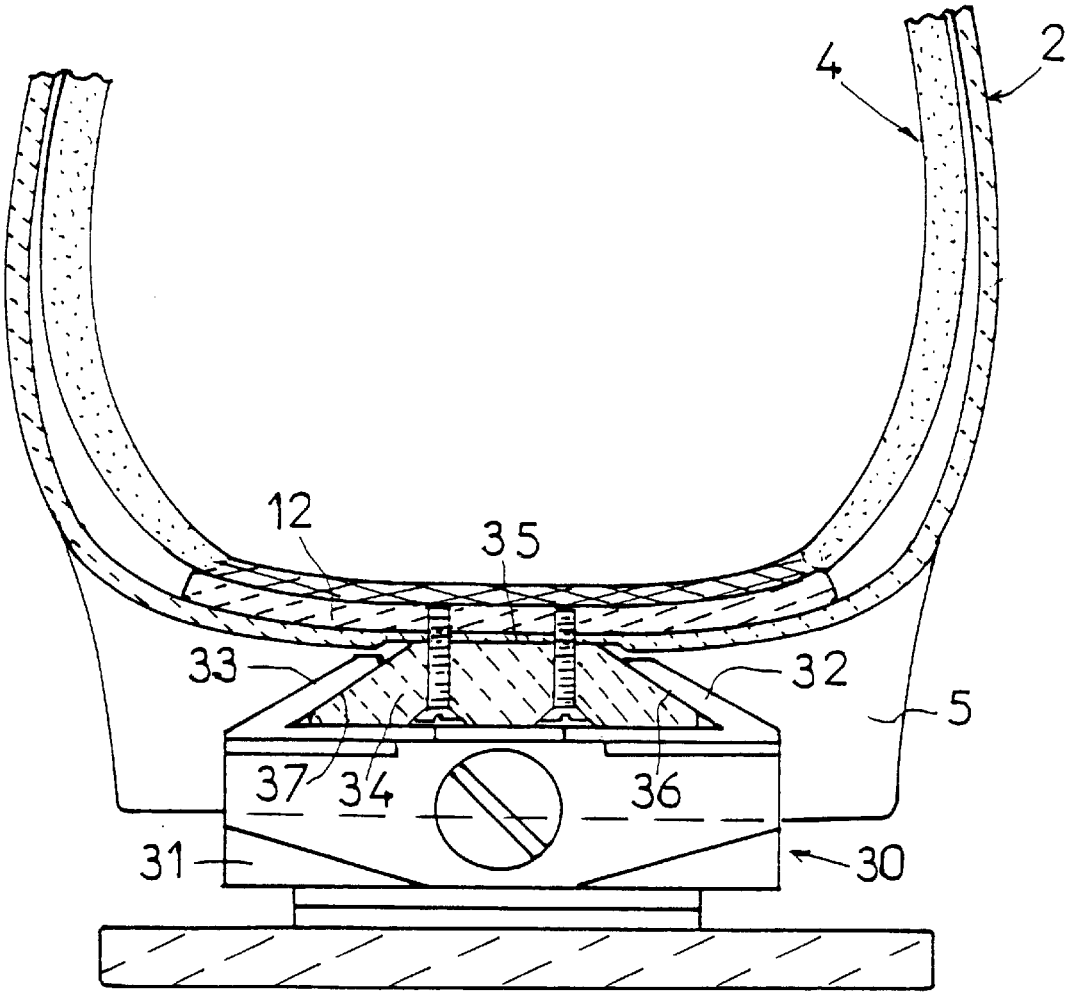
FIG. 10 is a view in section on the plane X–X' in FIG. 9.

In the embodiment illustrated in FIG. 9, the binding is in the general form of a platform (31) which includes a set of articulated arms (32, 33) which are intended to fit around a protruding portion (34) of the shoe (see FIGS. 9 and 10).

This protruding part (34) of the shoe is in the form of a conical or trapezoidal stud whose upper face (35) is in contact with the sole (5), the stud (34) being securely fastened to the sole (5). Two of the lateral faces (36, 37) have shapes or inclinations interacting with the binding (33, 32) with a view to its engagement.

This stud is advantageously inserted into the space lying at the front of the heel, so that it does not protrude beyond the lower face of the sole and therefore causes no discomfort during walking.

Of course, the invention encompasses all the binding variants of this type, that is to say ones having a single localized engagement zone of the type described above, or ones which are similar to the advanced bindings used on bicycle pedals, in contrast to conventional bindings which retain the shoe by its front and rear ends.

Figure 11:
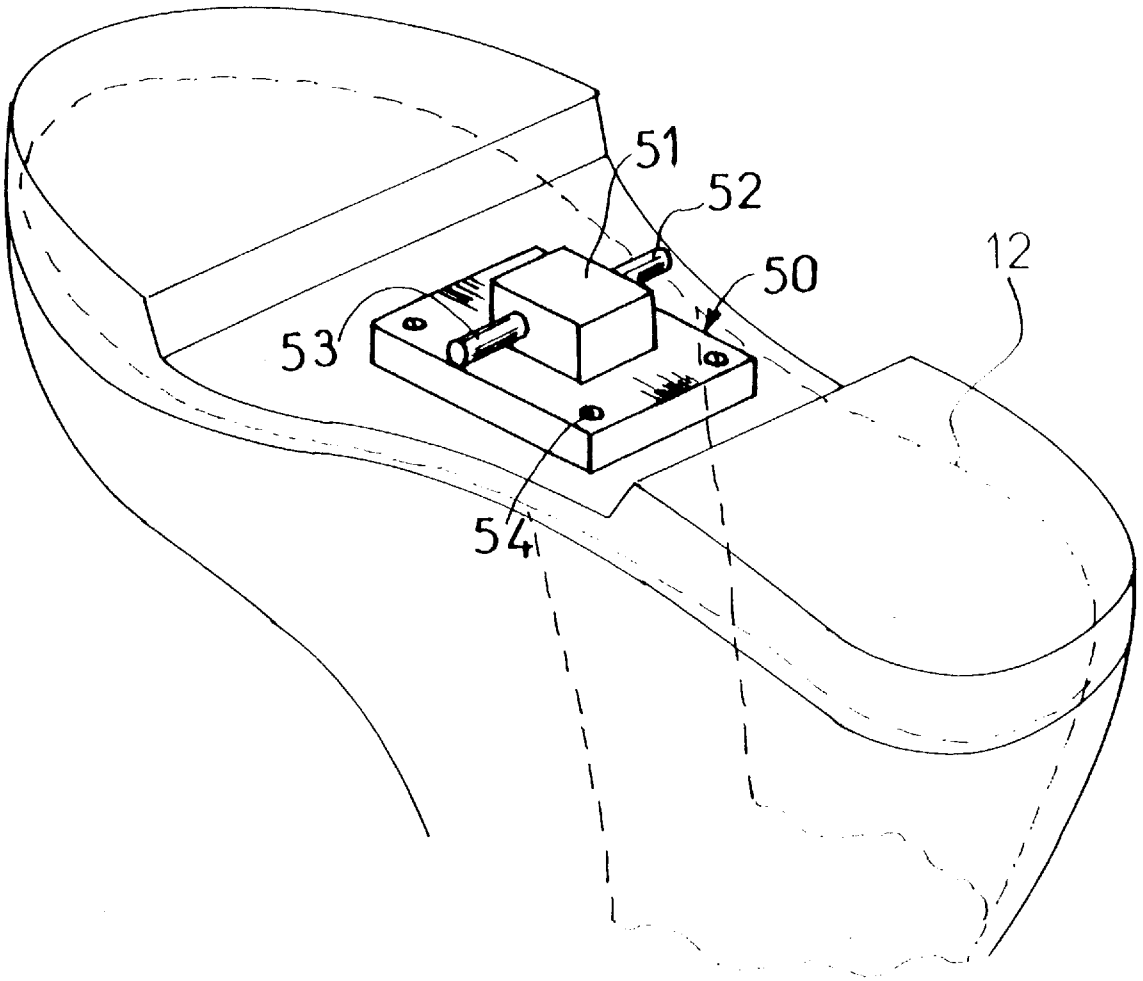
FIGS. 11 to 15 are schematic perspective bottom views of a shoe having three types of arrangements which are fixed on the sole of the shell and are intended to interact with bindings.

Five types of arrangements, represented in FIGS. 11 to 15, may be mentioned in this regard. Firstly, FIG. 11 shows a platform (50) which is fixed on the sole (12), at the arch of the foot, through the boot (2) by screws (54). A stud (51) which has two pins (52, 53) protruding from its two lateral faces is mounted on this platform (50). These pins (52, 53) are intended to interact with a complementary binding.

Figure 12:
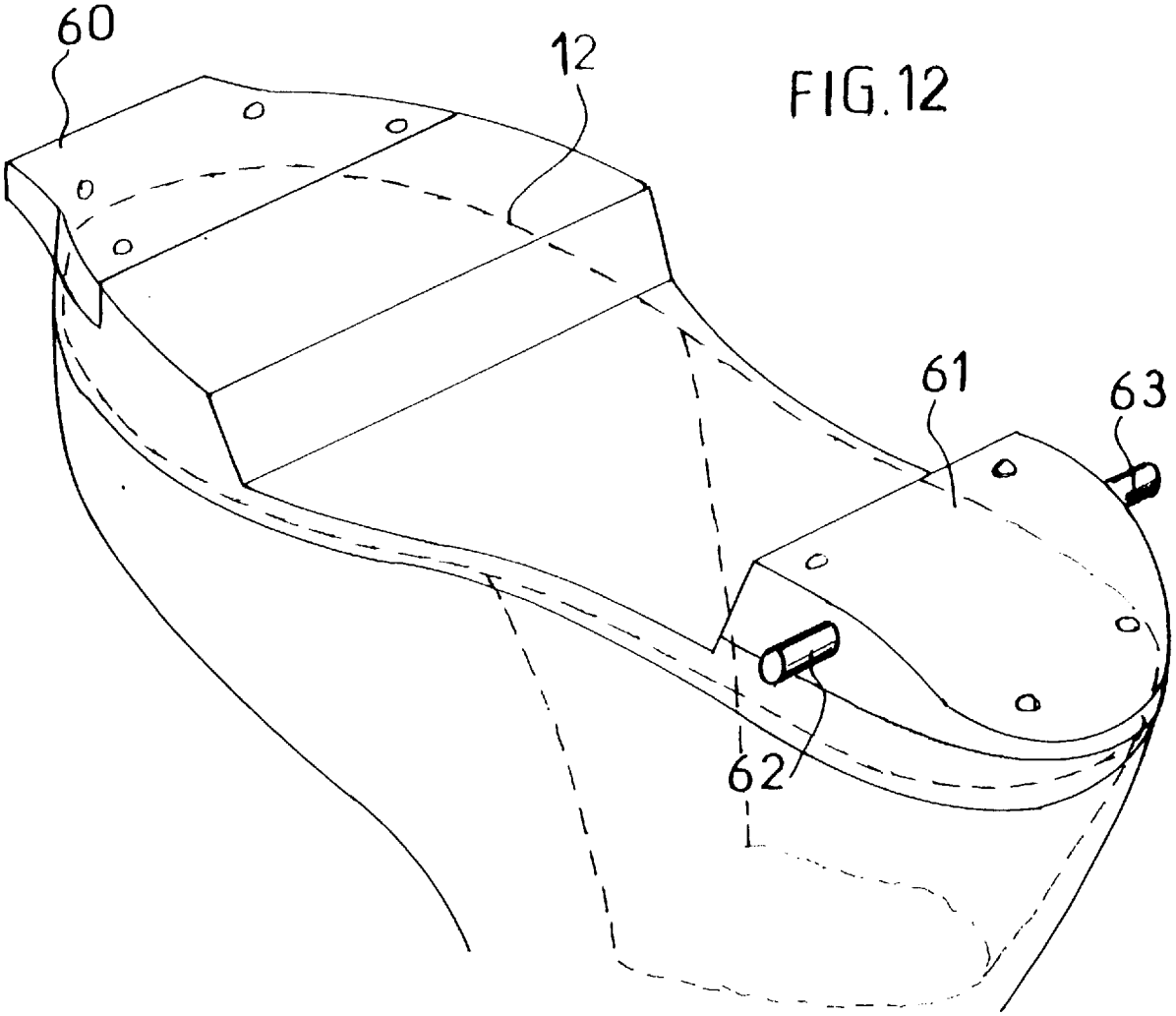

In the variant shown in FIG. 12, the interaction with the binding is produced jointly by an anterior tongue (60) and by a pair of pins (62, 63) emerging from the lateral faces of a platform (61) fixed on the sole (12) through the heel of the boot.

Figure 13:
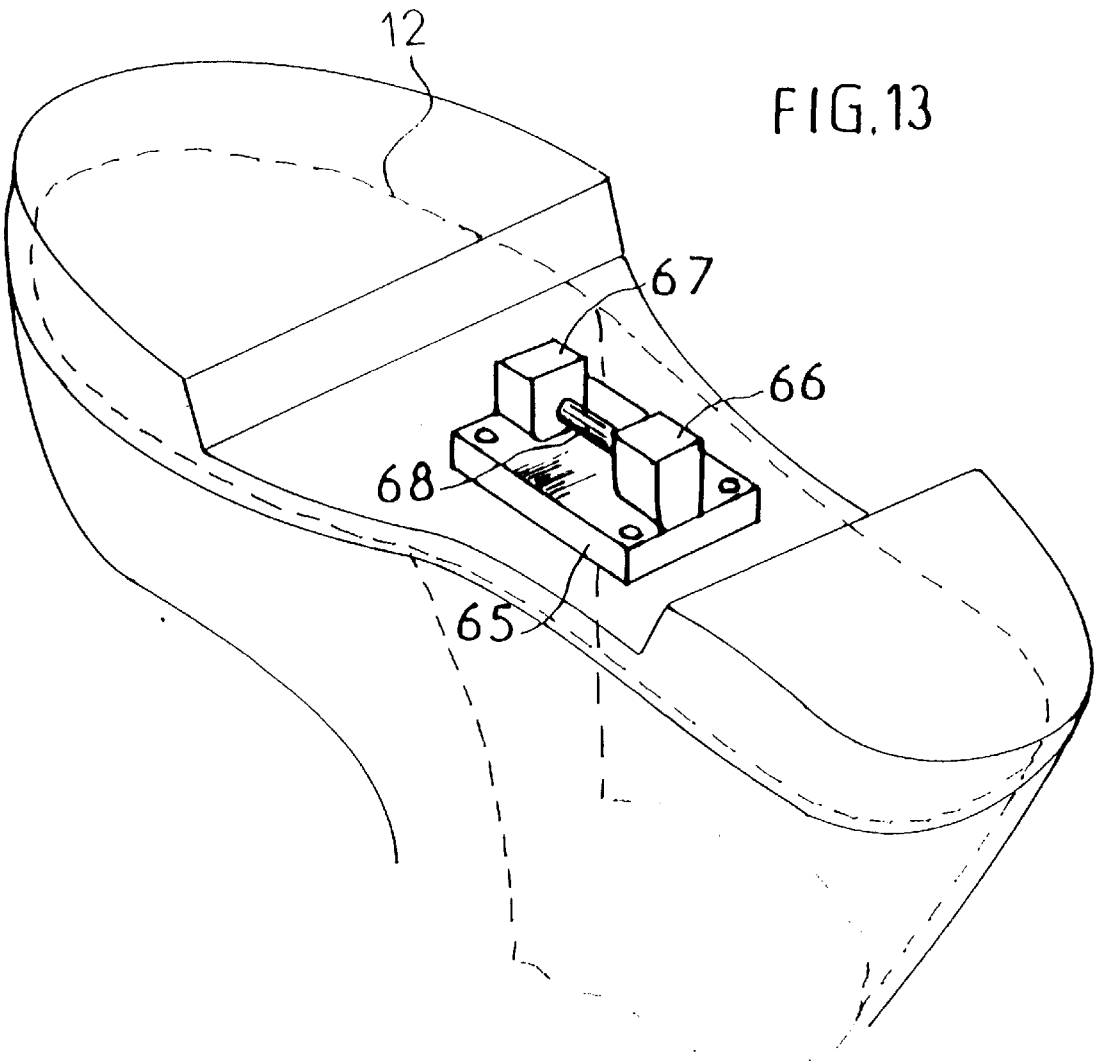

Moreover, in the variant illustrated in FIG. 13, the instep of the boot accommodates a platform (65) securely fastened to the sole (12) and having two studs (66, 67) trapping the two ends of a longitudinal pin (68).

In an alternative embodiment, the platform forms part of the sole (12) of the shell (3) and passes through the sole of the boot via a hole made for this purpose.

Figure 14:
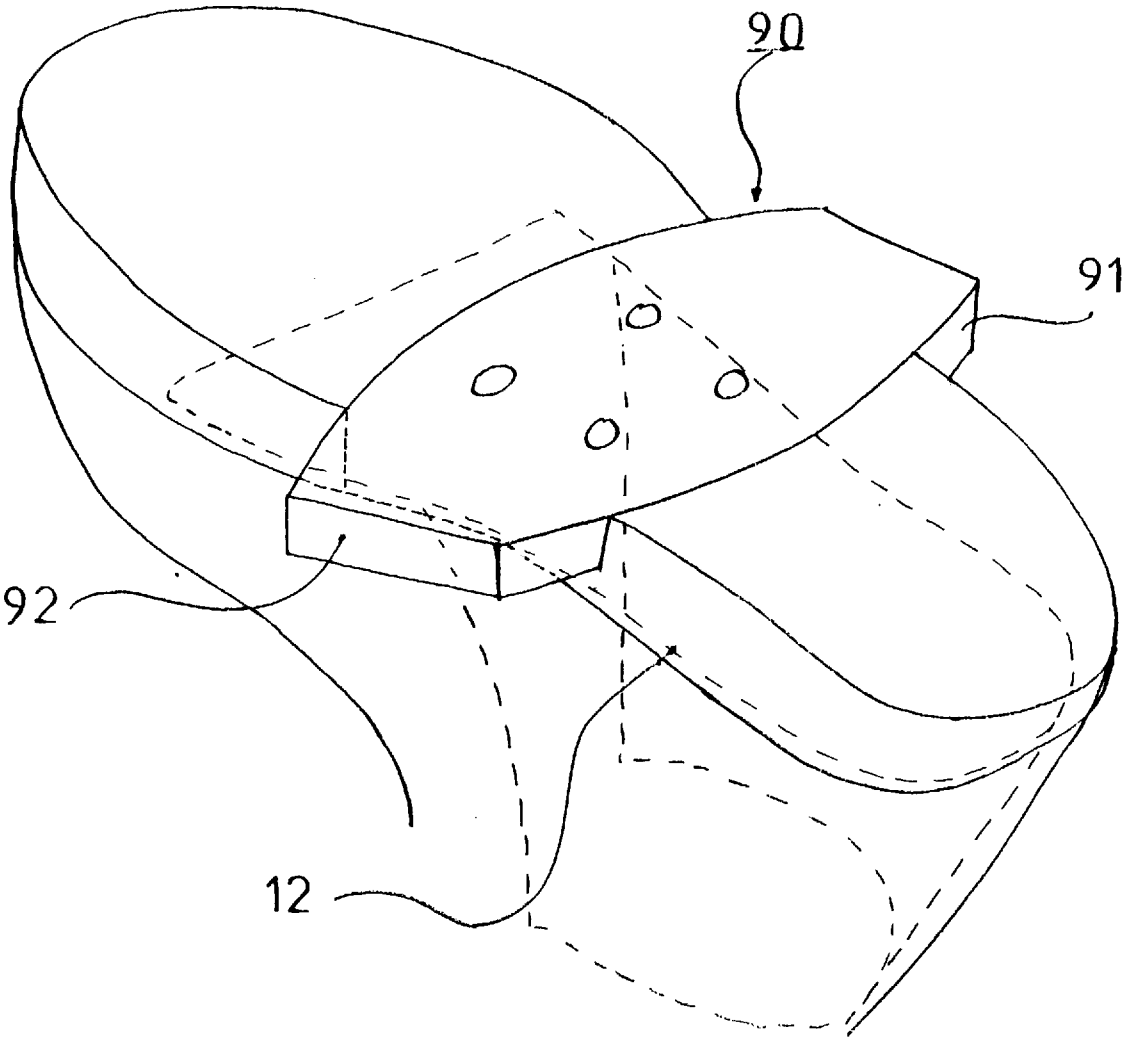

In the variant illustrated in FIG. 14, the instep of the boot accommodates a transverse wedge (90) which is wider than the sole (5) and whose lateral protrusions (91, 92) are intended to interact with the binding located on the board.

Figure 15:
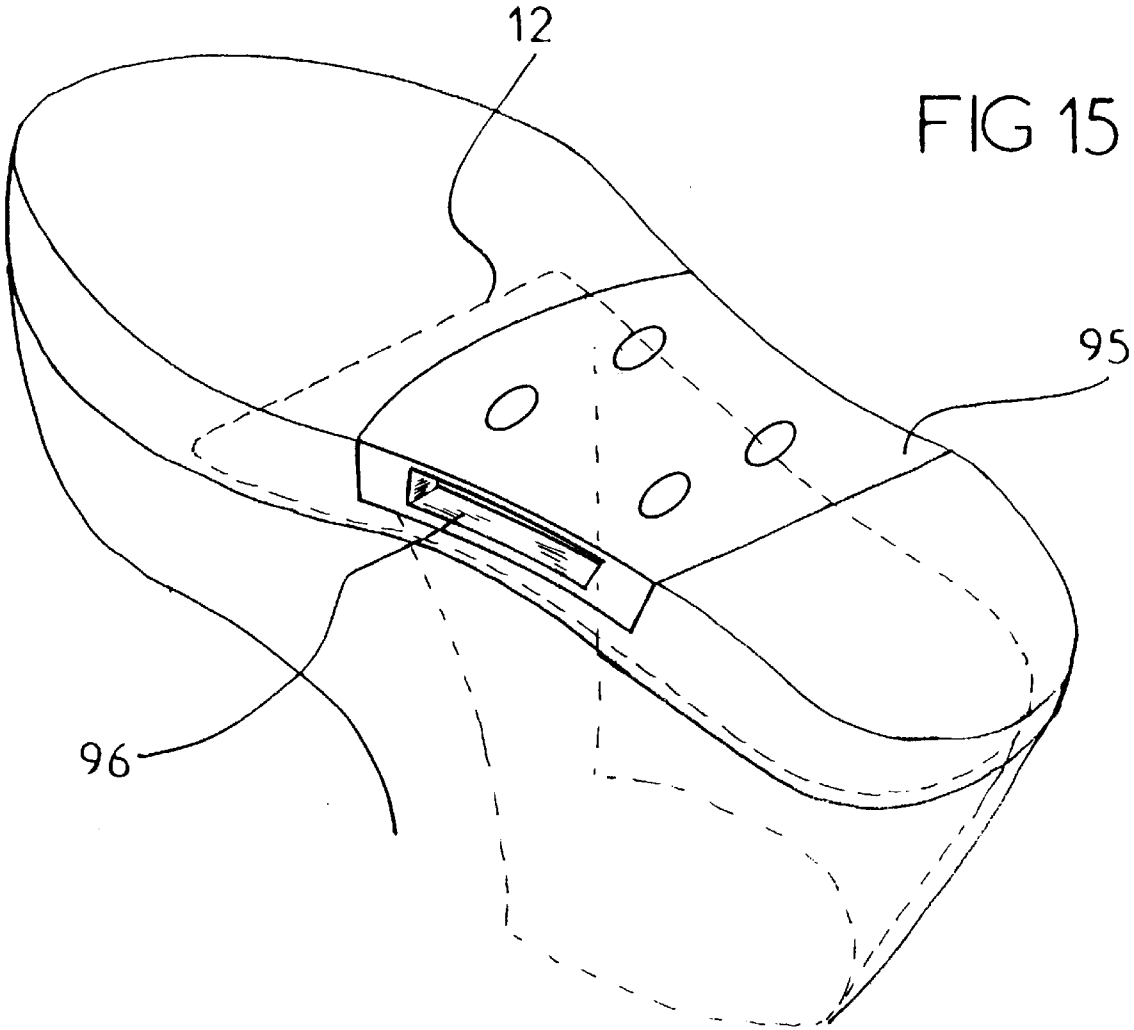

Finally, in the variant illustrated in FIG. 15, the sole (12) is combined with a piece (95) which has two lateral housings (96) at the lateral zones of the arch of the foot. The housings (96) are intended to receive jaws (not shown) of the binding.

One of the essential characteristics of the invention is therefore that it makes it possible to engage this stud (34) or equivalent members (50, 60, 61, 65, 90, 95) directly on the rigid sole by passing through the flexible boot (2) at a less thick zone. This preferably releasable engagement is performed by any known means, in particular by screwing.

To this end, the sole (5) is predrilled and the sole (12) may have screwing inserts (38) made of aluminum or light weight alloy.

The property of removablity permits the stud to be interchanged in order to adapt it to various types of binding, as well as the possibility of replacement in case of wear.

Figure 16:
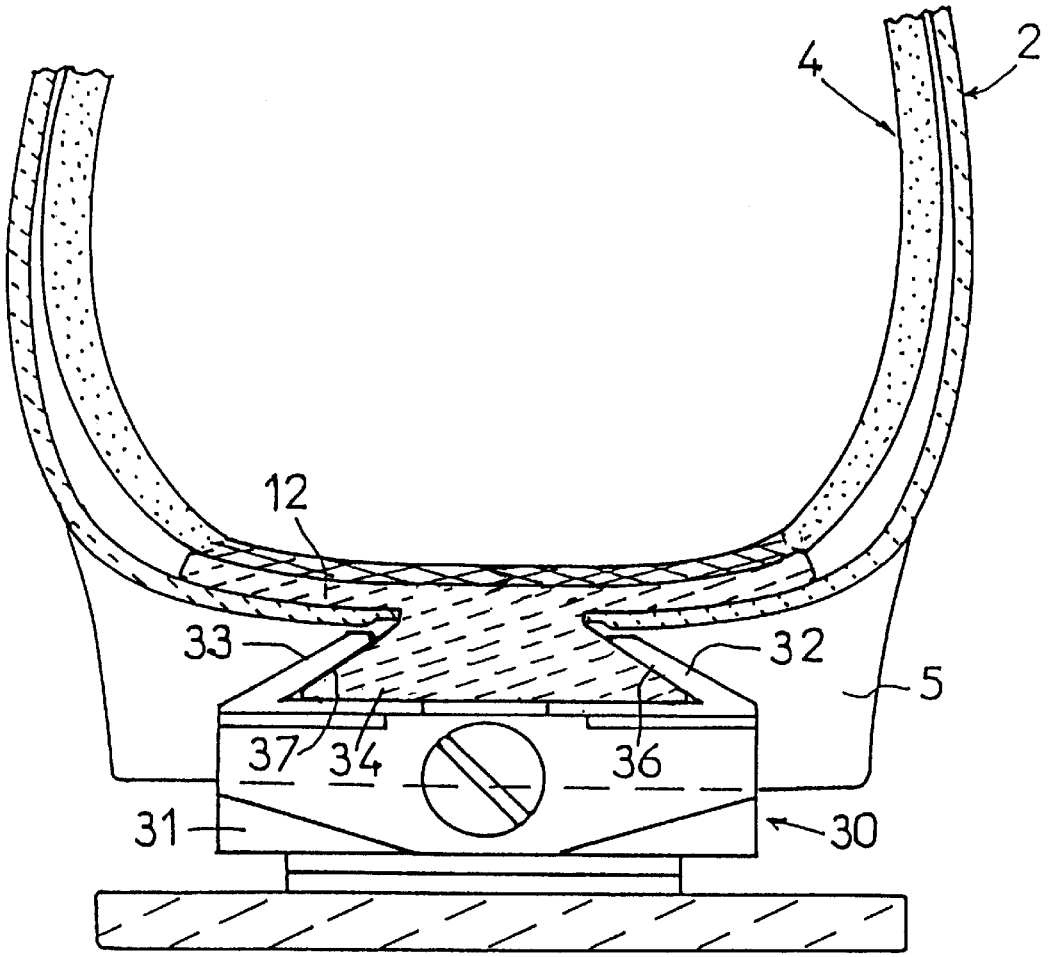
FIG. 16 is a view similar to that shown in FIG. 10, but showing the arrangements that interact with the binding as a molded extension of the inner shell.

The support (34) may advantageously constitute an extension of the sole (12) which passes through the sole of the boot (FIG. 16). However, in this embodiment, sealing problems may be encountered.

Thus, according to another embodiment, it may therefore prove advantageous to produce the boot in two steps, one of which consists in injection molding the rubber or PVC bottom part on and around the shell (3). This overcomes problems of sealing where the arrangements (34, 37) pass through the sole of the boot.

As regards the materials used for the sole, in order to promote comfort, zones made of flexible material may advantageously be combined with parts made of rigid material, or indeed a material reinforced with composite or metal inserts, in order to improve transfer of forces.

As can be seen from the above description, the snowboarding shoe according to the invention has many advantages including, in particular, the possibility of using a shoe having flexibility oriented forward and rigidity for rearward support, all of this being combined with a binding at a single engagement point. It should also be noted that the secure fastening of the engagement stud directly onto the sole allows an essential improvement in feeling by virtue of a direct transfer of forces from the foot to the snowboard.

As mentioned above, the invention has been described in detail in its application to a snow-boarding shoe, but by virtue of the flexibility combined with a degree or rearward rigidity and the direct transfer of forces from the board to the foot, it may naturally be employed advantageously for traditional ski boots.

I claim:

1. A shoe for the practice of a gliding sport using at least one board, said shoe having a capacity for forward flexing and comprising:

a flexible boot having a removable flexible inner shoe mounted therein;

a shell placed inside the flexible boot between the flexible boot and said inner shoe, said shell comprising a sole and a spoiler whereby the spoiler fits around the rear of a wearer's lower leg up to about the height of the wearer's calf, said spoiler being inclined toward the front of said sole and having sufficient rigidity to limit rearward inclination of said spoiler; and, interacting means for engaging a binding on the board, said interacting means passing through said flexible boot, said interacting means attached to said shell.

2. The shoe as claimed in claim 1, wherein:

said spoiler comprises a lower edge and an upper edge, said lower edge and said upper edge each having a radius of curvature, wherein said lower edge is securely fastened to a posterior part of said sole, and wherein said radius of curvature of said upper edge is greater than said radius of curvature of said lower edge.

3. The shoe as claimed in claim 1, wherein:

said shell further comprises articulation means for articulating said spoiler toward a front end of said sole, said shell further comprising means for limiting rearward inclination of said spoiler.

4. The shoe as claimed in claim 3, wherein:

said articulation means comprises a flexible connecting portion, said flexible connecting portion located between said sole and said spoiler.

5. The shoe as claimed in claim 3, wherein:

said means for limiting rearward inclination comprises a cable, said cable connecting said sole to said spoiler.

6. The shoe as claimed in claim 3, wherein:

said means for limiting rearward inclination comprises at least one lateral web, said web connecting said sole to said spoiler.

7. The shoe as claimed in claim 3, wherein:

said articulation means comprises at least two pivot hole assemblies, one of said assemblies located at a rear lateral part of said spoiler, another of said assemblies located at a bottom lateral part of said spoiler, wherein said spoiler inclines and articulates relative to said sole.

8. The shoe as claimed in claim 3, wherein:

said means for limiting rearward inclination comprises:

a protruding portion, said protruding portion located on said sole, and, said spoiler comprises a complementary portion, wherein said protruding portion interacts with said complementary portion.

9. The shoe as claimed in claim 8, wherein:

said complementary portion is articulated about a transverse pin, said complementary portion articulating between a first position and a second position, said first position permitting abutment with said protruding portion and said second position preventing abutment with said protruding portion, said complementary portion further comprising return means for returning said complementary portion to said first position.

10. The shoe as claimed in claim 3, wherein:

said articulation means comprises a stirrup piece, said stirrup piece articulating relative to said sole about a transverse pin arranged substantially at the malleoli of the wearer, and a longitudinal pivot located at a rear part of said stirrup piece, said longitudinal pivot accommodating a bottom part of said spoiler, wherein said spoiler inclinates transversely.

11. The shoe as claimed in claim 3, wherein:

said articulation means comprises a stirrup piece, said stirrup piece articulating relative to said sole about a longitudinal pin arranged on a rear part of said sole substantially at the Achilles tendon of the wearer, said articulation means further comprising two pivot hole assemblies, one of said assemblies located at a first end of said stirrup piece, and another of said assemblies located at a second end of said stirrup piece.

12. The shoe as claimed in claim 1, wherein:

said shell is removable from said boot.

13. The shoe as claimed in claim 1, wherein:

a bottom part of said boot is molded over said shell.

14. The shoe as claimed in claim 1, wherein:

said spoiler comprises means for tightening around a bottom portion of the calf of the wearer.

15. The shoe as claimed in claim 1, wherein:

said sole comprises means for holding the foot of the wearer at the instep.

16. The shoe as claimed in claim 1, wherein:

said sole comprises a zone of reduced thickness, said zone located in a region of said sole near said interacting means.

17. The shoe as claimed in claim 1, wherein:

said interacting means comprise a molded extension of said sole, said molded extension passing through said flexible boot.

18. The shoe as claimed in claim 1, wherein:

said sole comprises one of metal and composite inserts, said inserts serving as an engagement point for said interacting means.

19. The shoe as claimed in claim 1, wherein:

said sole extends at the front to and slightly set back from the metatarsophalangeal articulation of the foot of the wearer.

20. The shoe as claimed in claim 1, wherein:

said sole comprises a zone of reduced thickness, said zone located at a region slightly set back from the metatarsophalangeal articulation of the foot of the wearer.

* * * * *